US008353262B2

(12) United States Patent
Koga et al.

(10) Patent No.: US 8,353,262 B2
(45) Date of Patent: Jan. 15, 2013

(54) TWO-STROKE INTERNAL COMBUSTION ENGINE

(75) Inventors: Naoki Koga, Tokyo (JP); Shirou Yamaguchi, Tokyo (JP); Ken Shirai, Tokyo (JP); Daisuke Yamada, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 286 days.

(21) Appl. No.: 12/842,682

(22) Filed: Jul. 23, 2010

(65) Prior Publication Data

US 2011/0017183 A1 Jan. 27, 2011

(30) Foreign Application Priority Data

Jul. 24, 2009 (JP) ..... 2009-172820

(51) Int. Cl.

| | |
|---|---|
| ***F02B 23/00*** | (2006.01) |
| ***F02B 25/14*** | (2006.01) |
| ***F02B 25/16*** | (2006.01) |
| ***F02B 75/16*** | (2006.01) |

(52) U.S. Cl. ..... 123/73 PP; 123/65 P; 123/61 V; 123/69 V; 123/73 AA; 123/73 BA; 138/178

(58) Field of Classification Search ..... 123/61 V, 123/69 V, 70 V, 71 V, 65 VC, 65 VB, 65 WA, 123/76, 73 BA, 73 CA, 73 AA
See application file for complete search history.

(56) References Cited

U.S. PATENT DOCUMENTS

| | | | | |
|---|---|---|---|---|
| 3,752,129 A | | 8/1973 | Kobayashi et al. | |
| 4,016,850 A | * | 4/1977 | Bloemers | 123/193.2 |
| 5,490,483 A | * | 2/1996 | Tanikake et al. | 123/65 P |
| 5,762,040 A | * | 6/1998 | Hummel et al. | 123/73 PP |
| 5,870,981 A | | 2/1999 | Knaus et al. | |
| 6,223,705 B1 | * | 5/2001 | Sato et al. | 123/73 PP |
| 6,513,465 B2 | | 2/2003 | Fukuoka et al. | |
| 2009/0022610 A1 | * | 1/2009 | Materne et al. | 417/423.7 |

FOREIGN PATENT DOCUMENTS

| | | | |
|---|---|---|---|
| EP | 0558072 | | 9/1993 |
| GB | 2130642 | | 6/1984 |
| JP | 56018021 A | * | 2/1981 |
| JP | 11-315722 | | 11/1999 |
| JP | 4082868 | | 8/2002 |
| JP | 2008-274804 | | 11/2008 |
| WO | WO2004/033869 | | 4/2004 |

OTHER PUBLICATIONS

European Search Report of EP 10007558.9, dated Sep. 20, 2011 (corresponding to U.S. Appl. No. 12/842,682).

* cited by examiner

*Primary Examiner* — Nathaniel Wiehe
*Assistant Examiner* — Kevin Lathers
(74) *Attorney, Agent, or Firm* — Baker Botts LLP

(57) ABSTRACT

A reverse scavenged two-stroke internal combustion engine is capable of effectively suppressing the short-circuiting of fresh charge (unburnt air-fuel mixture), while at the same time being capable of further improving scavenging efficiency, combustion efficiency, etc. The horizontal sectional shape of at least one pair of scavenging passages is closer to a triangle than a parallelogram along substantially the entire lengths of the at least one pair of scavenging passages, where a cylinder outer circumferential side of the horizontal sectional shape is narrowest and a cylinder bore wall surface side of the horizontal sectional shape is wide. Further, horizontal scavenging angles, which are angles of intersection formed between lines extended towards an intake port from guide wall surfaces that define the scavenging passages, are acute.

13 Claims, 9 Drawing Sheets

(A) < Present invention (First embodiment) >

(B)

< Prior art (Conventional example) >

< Present invention (Second embodiment) >

(A)

< Present invention (Second embodiment) >

(B)

< Prior art (Conventional example) >

(A)

< Present invention (Second embodiment) >

(B)

< Prior art (Conventional example) >

TWO-STROKE INTERNAL COMBUSTION ENGINE

BACKGROUND INFORMATION

1. Field of the Invention

The present invention relates to two-stroke internal combustion engines comprising one pair or a plurality of pairs of scavenging passages that adopt a reverse scavenging system, and more specifically to two-stroke internal combustion engines that are capable of suppressing the short-circuiting of fresh charge (unburnt air-fuel mixture), while at the same time also being capable of improving scavenging efficiency, combustion efficiency, and the like.

2. Background Art

Ordinarily, in standard two-stroke gasoline engines conventionally used in portable powered work machines, such as lawn mowers, chainsaws, etc., a spark plug is disposed at a head portion of a cylinder. An intake port, a scavenging port, and an exhaust port that are opened/closed by a piston are formed in a barrel portion of the cylinder. There are no independent strokes dedicated to intake and exhaust alone. And one cycle of the engine is completed with two strokes of the piston.

More specifically, by an up-stroke of the piston, an air-fuel mixture is drawn into a crankchamber below the piston from the intake port, while the air-fuel mixture is pre-pressurized by a down-stroke of the piston and the pre-pressurized air-fuel mixture is blown out from the scavenging port into a combustion actuating chamber above the piston, thereby exhausting the combustion waste gas to the exhaust port. In other words, the scavenging of the combustion waste gas is performed utilizing the gas flow of the air-fuel mixture.

For this reason, an unburnt air-fuel mixture often becomes mixed in the combustion waste gas (exhaust gas), the amount of fresh charge (unburnt air-fuel mixture) that is exhausted into the atmosphere without being used for combustion, that is, the so-called short circuited amount, is large, and fuel economy is inferior as compared to four-stroke engines. Further, HC (unburnt components of the fuel), CO (incomplete combustion components of the fuel), etc., which are noxious components, are contained in the exhaust gas in large amounts. Therefore, while the machines may be small in size, environmental pollution still is a concern, and there are such issues as how to accommodate emission regulations as well as demands for improved fuel economy, which are bound to become even more stringent in the years to come.

In view of such issues, various improvements have hitherto been proposed with regard to the shape and structure of scavenging passages as can be seen in Patent Documents 1 and 2 cited below, for example.

In addition, with respect to a two-stroke internal combustion engine comprising one pair or a plurality of pairs of scavenging passages that adopt a reverse scavenging system (Schnürle-scavenging system) in such a manner as to communicate a combustion actuating chamber formed above a piston with a crankchamber, the present applicant has also previously proposed the forming of, in a planar member (gasket) fitted between a cylinder, into which the piston is fitted and inserted, and the crankcase, throttling holes or throttling cutout openings of fixed opening areas that are smaller than the sectional areas of the scavenging passages in order to throttle the vicinity of inlets of the scavenging passages as disclosed in Patent Document 3 cited below.

According to this proposal, since the throttling holes are provided near the scavenging inlets, the pressure difference between the crankchamber and a point in the scavenging passages downstream of the throttling holes becomes greater as compared to a case where no throttling holes are provided, and the air-fuel mixture of the crankchamber bursts out from the throttling holes at once and flow downstream thereof. In other words, the pressure and flow speed of the scavenging gas are increased as compared to a case where the vicinity of the scavenging inlets of the scavenging passages is not throttled, and the scavenging gas that has passed through the throttling holes is blown out into the combustion actuating chamber from scavenging outlets while expanding rapidly and generating a predetermined turbulence.

Thus, the atomization of fuel is facilitated, scavenging efficiency (trapping efficiency) improves, while at the same time combustion efficiency also improves. Consequently, the desired output is obtained with less fuel, the noxious components within the exhaust gas, THC [=total amount of unburnt gas components such as HC (hydrocarbon) and the like] in particular, can be reduced effectively and, further, fuel economy improves as well.

[Patent Document 1] JP Patent Publication (Kokai) No. 2008-274804 A

[Patent Document 2] JP Patent Publication (Kokai) No. 11-315722 A (1999)

[Patent Document 3] JP Patent No. 4082868

SUMMARY

However, with the hitherto proposed techniques, it cannot be said that emission regulations and demands for improved fuel economy, which are bound to become even more stringent in the years to come, can be addressed to a sufficient extent, and the situation is such that there are strong demands for a new technique that is capable of suppressing the short-circuiting of fresh charge more than has been possible, while at the same time being capable of further improving scavenging efficiency, combustion efficiency, etc.

The present invention has been made in order to address such demands, and an object thereof is to provide a reverse scavenged two-stroke internal combustion engine that is capable of effectively suppressing the short-circuiting of fresh charge, while at the same time being capable of further improving scavenging efficiency, combustion efficiency, etc.

In order to achieve the object above, a two-stroke internal combustion engine according to the present invention basically comprises one pair or a plurality of pairs of scavenging passages that adopt a reverse scavenging system in such a manner as to communicate a combustion actuating chamber, which is formed above a piston, with a crankchamber, wherein the horizontal sectional shape of at least one pair of the scavenging passages is closer to a triangle than a parallelogram along substantially the entire lengths of the at least one pair of the scavenging passages, where the cylinder outer circumferential side of the horizontal sectional shape is narrowest and the cylinder bore wall surface side of the horizontal sectional shape is wide, and wherein horizontal scavenging angles, which are angles of intersection formed between lines extended towards an intake port from guide wall surfaces that define the scavenging passages, are made to be acute.

In a preferred embodiment, the lines extended from at least one pair of the scavenging passages fall outside of a tangent line that passes through an end point of a scavenging outlet of the scavenging passages that is closest to the intake port.

In a preferred embodiment, the scavenging passages are provided symmetrically about a central vertical section that bisects the intake port.

In another preferred embodiment, the scavenging passages are provided symmetrically about an inclined vertical section that is, as viewed planarly, inclined by a predetermined angle relative to a central vertical section that bisects the intake port and/or an exhaust port.

In this case, in a preferred embodiment, the exhaust port is, as viewed planarly, so provided as to be eccentric relative to the central vertical section.

In yet another preferred embodiment, the cylinder and an upper crankcase are formed integrally, and lower ends of the scavenging passages open to a main bearing receiving face of the upper crankcase.

In yet another preferred embodiment, a great part of at least a pair of the scavenging passages are passage portions with partitions, and a cutout opening or a through-hole, which serves as a scavenging inlet, the upper portion or the whole of which is substantially triangular where it becomes narrower towards the upper side, is formed in a lower end portion of at least one of the partitions.

In this case, the upper portion or the whole of the cutout opening or the through-hole that serves as the scavenging inlet is preferably made to be a triangular shape that widens at a constant rate of change towards a lower end opening portion.

In yet another preferred embodiment, there are provided two pairs of the scavenging passages, and the cutout opening or the through-hole, the upper portion or the whole of which is triangular, is formed in a lower end portion of at least one of the partitions of the scavenging passages located on the intake port side.

With a reverse scavenged two-stroke internal combustion engine according to the present invention, because the horizontal sectional shape of the scavenging passages is closer to a triangle than a parallelogram (i.e., the conventional horizontal sectional shape) along substantially the entire lengths of the scavenging passages, where the cylinder outer circumferential side of the horizontal sectional shape is narrowest and the cylinder bore wall surface side of the horizontal sectional shape is wide, by way of the effects of this shape and of reducing the passage sectional area, the scavenging flow speed through the scavenging passages is increased, scavenging efficiency improves and, further, the scavenging flow speed into the combustion actuating chamber is also increased, and more air-fuel mixture is supplied, thereby making it possible to improve output, fuel economy, etc. In addition, as the scavenging flow speed into the combustion actuating chamber increases, flame propagation speed increases, thereby allowing for an improvement in combustion efficiency.

In addition, because the horizontal scavenging angles, which are the angles of intersection formed between the lines extended towards the intake port from the guide wall surfaces that define the scavenging passages, are made to be acute and, in a preferred embodiment, the lines extended from at least one pair of the scavenging passages fall outside of a tangent line that passes through an end point of the scavenging outlet of the scavenging passages that is closest to the intake port, it is possible to impart directionality to the air-fuel mixture blown out from the scavenging outlet towards the intake port of the combustion actuating chamber, thereby making it possible to suppress the short-circuiting of fresh charge. For this reason, in combination with the above-mentioned effects of the shape and of reducing the passage sectional area, there are considerable improvements in scavenging efficiency and combustion efficiency, making it possible to dramatically reduce THC, while at the same time making it possible to further improve output and fuel economy.

Further, with a reverse scavenged two-stroke internal combustion engine of this kind, for purposes of convenience in molding the cylinder and the crankcase, the lower ends of the scavenging passages are ordinarily made to open to the main bearing receiving face of the upper crankcase. In other words, when the lower ends of the scavenging passages are closed, they become undercut portions, making molding difficult. In the present invention, the sectional shape of the scavenging passages is made to be a triangle-like shape as mentioned above, and the passage sectional area is made considerably smaller than its conventional counterpart (approximately 60% of the conventional example in the embodiments of the present invention), as a result of which the opening area of the main bearing receiving face is made considerably smaller than is conventional. Consequently, the area of the main bearing receiving face subjected to pressure can be made larger than its conventional counterpart, as a result of which support for the crankshaft stabilizes, and it is possible to suppress torque variation and the like as much as possible. In addition, since stiffness increases, deformation by heat is suppressed, and seizure resistance improves.

DESCRIPTION OF SYMBOLS

1 Two-stroke internal combustion engine (first embodiment)
2 Two-stroke internal combustion engine (second embodiment)
10 Cylinder

15 Combustion actuating chamber
18 Crankchamber
20 Piston
31 First scavenging passage
32 Second scavenging passage
31*a*, 32*a* Scavenging inlet
31*b*, 32*b* Scavenging outlet
31*c*, 32*c* Guide wall surface
33 Intake port
34 Exhaust port

DETAILED DESCRIPTION OF THE PREFERRED EMBODIMENTS

Embodiments of the present invention (first and second embodiments) are described below with reference to the drawings.

Figure 1:
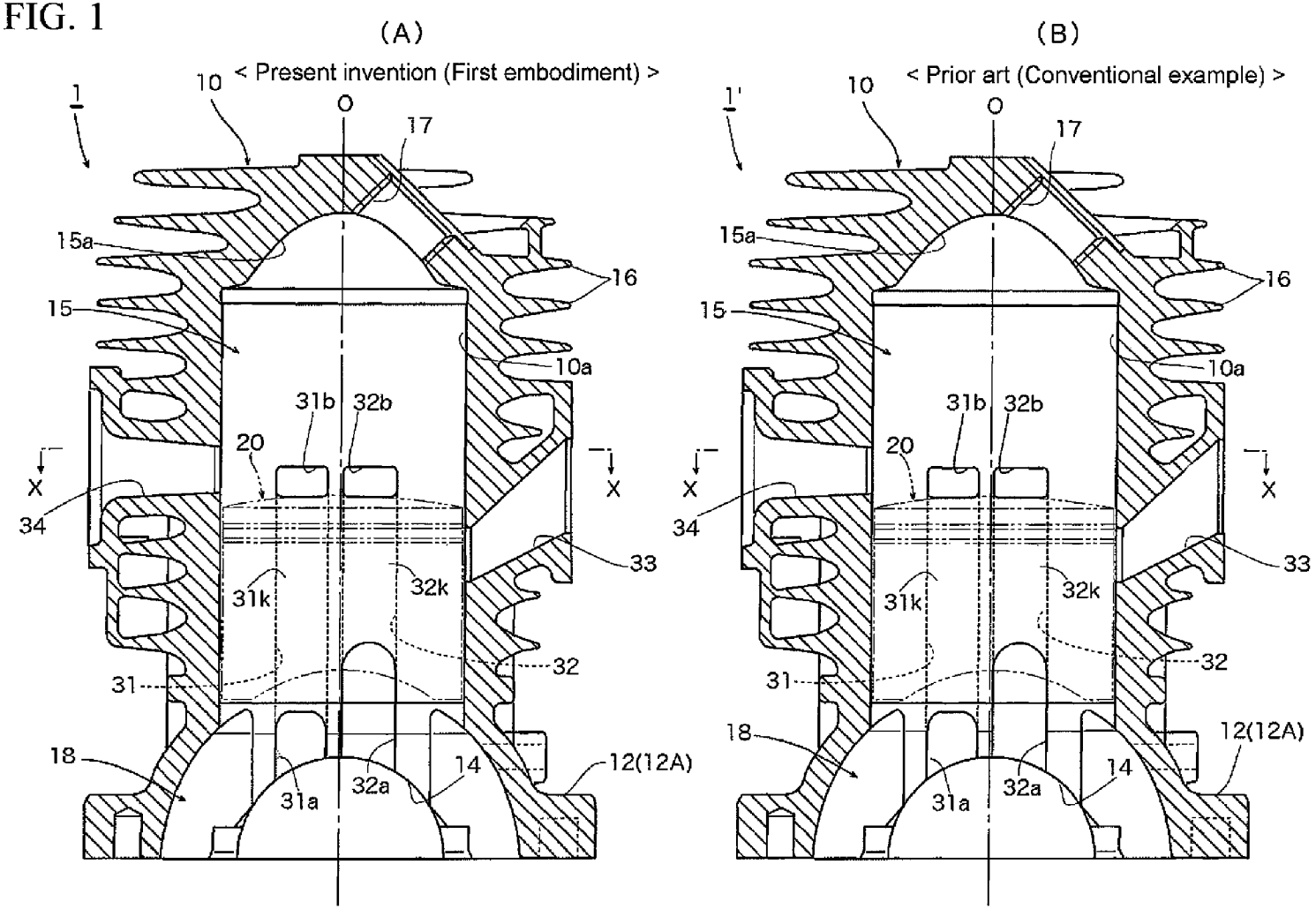
FIG. 1(A) is a vertical sectional view showing the main portion of the first embodiment of a reverse scavenged two-stroke internal combustion engine according to the present invention (present invention)
FIG. 1(B) is a vertical sectional view showing the main portion of an example of a conventional reverse scavenged two-stroke internal combustion engine (prior art).
Figure 2:
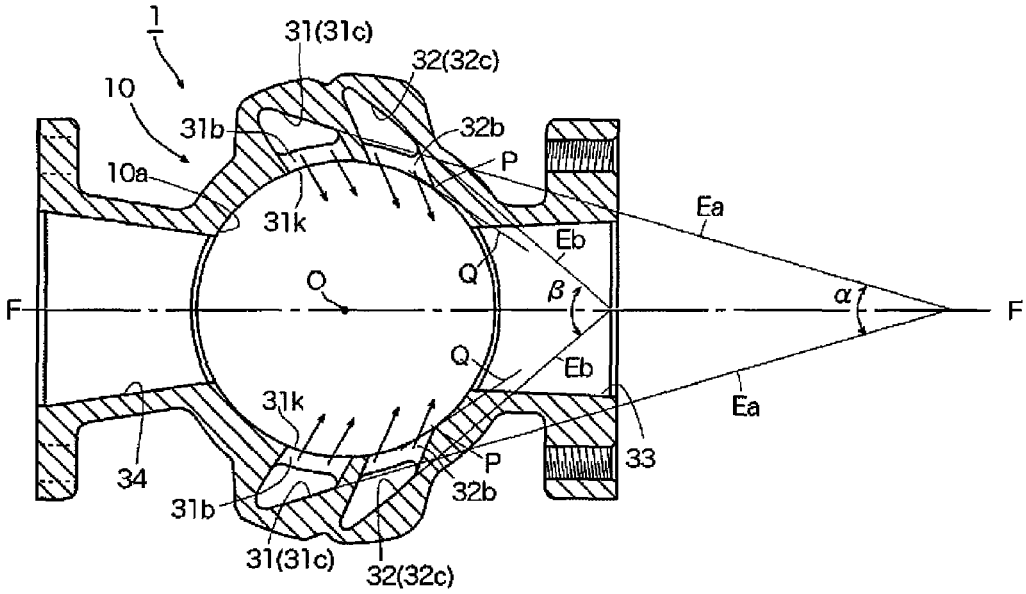
FIG. 2(A) is a sectional view taken along and as viewed in the direction of arrows X-X in FIG. 1(A)
FIG. 2(B) is a sectional view taken along and as viewed in the direction of arrows X-X in FIG. 1(B).
Figure 2:
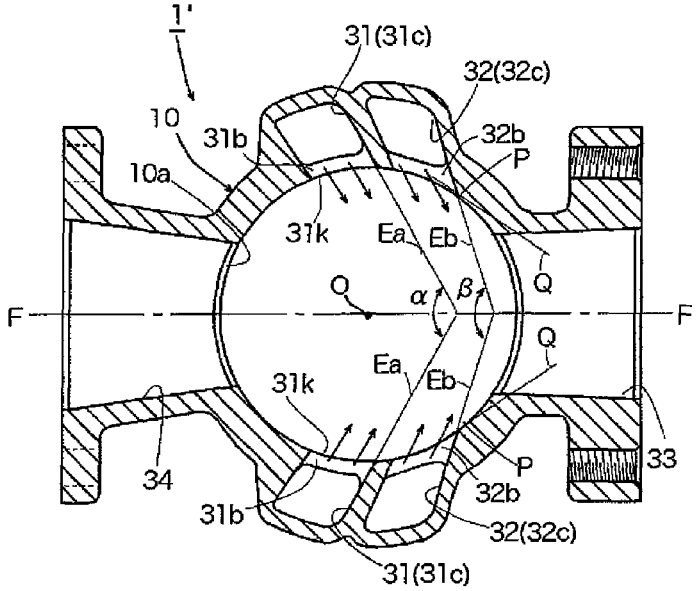
Figure 3:
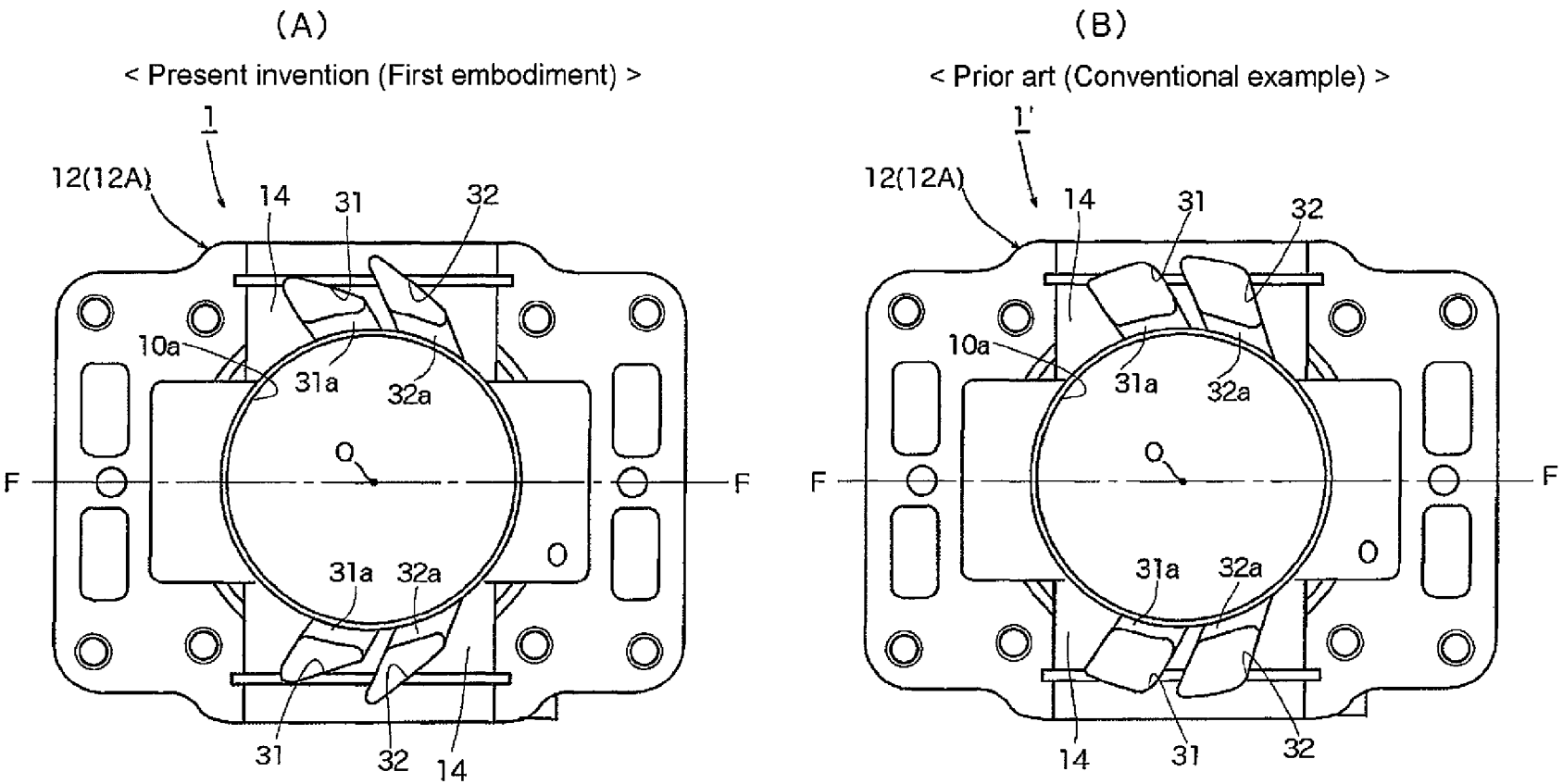
FIG. 3(A) is a base view of the main portion of the engine shown in FIG. 1(A) (present invention)
FIG. 3(B) is a base view of the main portion of the engine shown in FIG. 1(B) (prior art).

FIG. 1(A) is a vertical sectional view of an embodiment (first embodiment) of a reverse scavenged two-stroke internal combustion engine according to the present invention, and FIG. 1(B) is a vertical sectional view of a conventional example of a reverse scavenged two-stroke internal combustion engine. FIG. 2(A) is a sectional view taken along and as viewed in the direction of arrows X-X in FIG. 1(A), and FIG. 2(B) is a sectional view taken along and as viewed in the direction of arrows X-X in FIG. 1(B). FIG. 3(A) is a base view of the main portion of the engine shown in FIG. 1(A), and FIG. 3(B) is a base view of the main portion of the engine shown in FIG. 1(B). Line O-O in FIGS. 1(A) and 1(B) illustrates the axis of cylinder 10, defined through the center O of cylinder 10 illustrated in FIGS. 2(A)-2(B) and 3(A)-3(B). With respect to the engines of the first embodiment of the present invention and of the conventional example, like parts or parts with the same function are designated with like reference numerals.

A description is provided below mainly with regard to portions that differ between an engine 1 of the first embodiment (present invention) and an engine 1' of the conventional example (prior art).

The illustrated reverse scavenged two-stroke internal combustion engine 1 is a small air-cooled two-stroke gasoline engine of a four-port scavenging system used in portable powered equipment and the like, comprising a cylinder 10 in which a piston 20 is inserted and fitted, wherein an upper crankcase 12A, which constitutes the upper half of a crankcase 12, is integrally formed below the cylinder 10. An unillustrated lower crankcase is fastened in a sealed state below the upper crankcase 12A by means of, for example, four through bolts. The crankcase 12 defines a crankchamber 18 below the cylinder 10, and rotatably supports, via a main bearing, a crankshaft that reciprocates the piston 20 via a con rod.

Plural cooling fins 16 are provided on an outer circumferential portion of the cylinder 10. A squish dome shaped (hemispherical) combustion chamber portion 15*a* constituting a combustion actuating chamber 15 is provided at a head portion of the cylinder 10. A mounting hole (internal thread portion) 17 by which a spark plug (not shown) is installed is formed in the combustion chamber portion 15*a*.

In addition, an exhaust port 34 is provided on one side of the barrel portion of the cylinder 10, and an intake port 33 is provided on the other side of the barrel portion at a lower position than the exhaust port 34 (in FIGS. 2(A) and (B), the exhaust port 34 and the intake port 33 are shown as if they are located at the same height).

In addition, in the two-stroke internal combustion engine 1 of the present embodiment, a pair of first scavenging passages 31, 31 located on the side of the exhaust port 34 and a pair of second scavenging passages 32, 32 located on the opposite side to the exhaust port 34 (i.e., on the side of the intake port 33), which adopt a reverse scavenging system (Schnürle-scavenging system), are provided from the cylinder 10 to the upper crankcase 12A. The first and second scavenging passages 31, 31 and 32, 32 are so provided as to be symmetrical about a central vertical section F-F that bisects the intake port 33 and the exhaust port 34.

The first and second scavenging passages 31, 31 and 32, 32 are, in large part, passage portions with partitions 31*k*, 31*k* and 32*k*, 32*k*, respectively. Their lower ends open to a main bearing receiving face (half-cylindrical surface) 14 of the upper crankcase 12A.

At lower end portions of the respective partitions 31*k*, 31*k* and 32*k*, 32*k* of the scavenging passages 31, 31 and 32, 32, substantially rectangular cutout openings 31*a*, 31*a*, and 32*a*, 32*a*, which serve as scavenging inlets, are respectively formed. Here, the opening area and height of the scavenging inlets (cutout openings) 32*a*, 32*a* formed in the second scavenging passages 32, 32 located on the side of the intake port 33 are made to be greater than the opening area and height of the scavenging inlets (cutout openings) 31*a*, 31*a* formed in the first scavenging passages 31, 31 located on the side of the exhaust port 34.

In addition, as is evident from FIGS. 2(A) and (B), rectangular first scavenging outlets 31*b*, 31*b* and second scavenging outlets 32*b*, 32*b* that open into the combustion actuating chamber 15 are respectively provided at the upper ends (downstream ends) of the first scavenging passages 31, 31 and the second scavenging passages 32, 32. Here, the first scavenging outlets 31*b*, 31*b* and the second scavenging outlets 32*b*, 32*b* are provided at the same height, and their upper end height is made lower than the upper end of the exhaust port 34 by a predetermined amount. Thus, the first scavenging outlets 31*b*, 31*b* and the second scavenging outlets 32*b*, 32*b* are such that, when the piston 20 moves downward, both pairs open simultaneously following a slight delay from the exhaust port 34.

Figure 4:
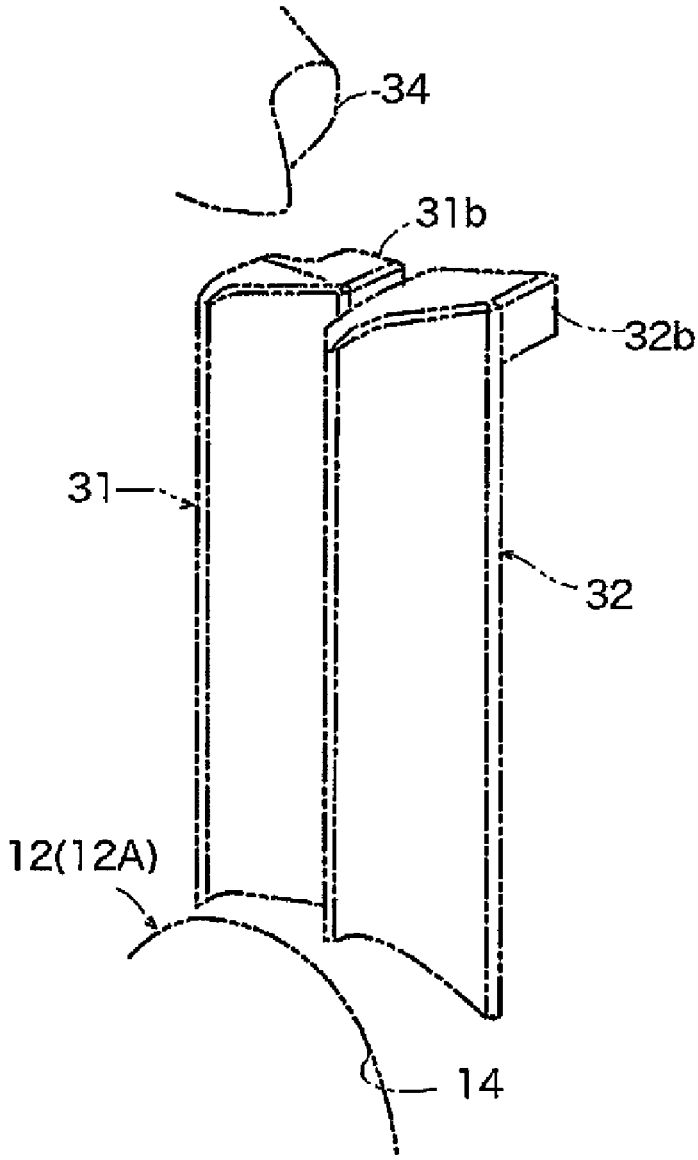
FIG. 4 is a schematic perspective view of a scavenging passage portion of the first embodiment.

The configuration above is common to the present embodiment (present invention) and the conventional example (prior art). However, whereas the horizontal sectional shape of the scavenging passages 31, 31 and 32, 32 along substantially the entire lengths thereof in the conventional example is a parallelogram with rounded corners where the side closer to the cylinder outer circumference is slightly wider than the side closer to the cylinder bore wall surface 10*a*, the horizontal sectional shape of the scavenging passages 31, 31 and 32, 32 along substantially the entire lengths thereof in the present embodiment is, as is evident from FIGS. 2(A) and (B) and FIGS. 3(A) and (B) as well as FIG. 4, a shape that is closer to a triangle (a triangle with rounded corners) than a parallelogram where the side closer to the cylinder outer circumference is narrowest and the side closer to the cylinder bore wall surface 10*a* is wide. Further, the horizontal scavenging angles $\alpha$ and $\beta$, which are angles of intersection formed between lines Ea, Ea and Eb, Eb extended from guide wall surfaces 31*c*, 31*c* and 32*c*, 32*c*, respectively, which define the intake port sides of the scavenging passages 31, 31 and 32, 32, towards the intake port 33, are both made to be acute (they are obtuse in the conventional example).

In addition, in the present embodiment, the lines Ea, Ea extended from the scavenging passages 31, 31 intersect outside of tangent lines Q that pass through end points P of the scavenging outlets 32*b*, 32*b* that are closest to the intake port 33 among the scavenging outlets 31*b*, 31*b* and 32*b*, 32*b* of the scavenging passages 31, 31 and 32, 32.

With the two-stroke internal combustion engine 1 of the present embodiment thus configured, as the pressure in the crankchamber 18 drops in the up-stroke of the piston 20, an air-fuel mixture from an air-fuel mixture generating means, such as a carburetor or the like that is not shown in the drawings, is drawn into and captured in the crankchamber 18 from the intake port 33.

As the air-fuel mixture within the combustion actuating chamber 15 above the piston 20 is then ignited to explode and combust, the piston 20 is pressed downward by the combustion gas. In this down-stroke of the piston 20, the air-fuel mixture within the crankchamber 18 and the scavenging passages 31, 31 and 32, 32 is compressed by the piston 20, while at the same time the exhaust port 34 is opened first, and as the piston 20 moves further downward, the respective scavenging outlets 31*b*, 31*b* and 32*b*, 32*b* at the downstream ends of the scavenging passages 31, 31 and 32, 32 are opened simultaneously. During this scavenging period in which the scavenging outlets 31*b*, 31*b* and 32*b*, 32*b* are opened, the air-fuel mixture compressed inside the crankchamber 18 is pushed into the scavenging passages 31, 31 and 32, 32 from the scavenging inlets 31*a*, 31*a* and 32*a*, 32*a*, while at the same time being drawn towards the combustion actuating chamber 15, blown out towards the cylinder bore wall surface 10*a* on the opposite side to the exhaust port 34 (i.e., on the side of the intake port 33) as scavenging flows from the scavenging outlets 31*b*, 31*b* and 32*b*, 32*b* at a predetermined horizontal scavenging angle, and made to collide with the wall surface and turn around, thereby pushing out the combustion waste gas to the exhaust port 34.

Here, because in the reverse scavenged two-stroke internal combustion engine 1 of the present embodiment, the horizontal sectional shapes of the scavenging passages 31, 31 and 32, 32 along substantially the entire lengths thereof are made to be a shape that is closer to a triangle than a parallelogram (i.e., the horizontal sectional shape in the conventional example) where the side closer to the cylinder outer circumference is narrowest and the side closer to the cylinder bore wall surface 10*a* is wide, by virtue of the effects of this shape and of reducing the passage sectional area, the scavenging flow speed through the scavenging passages 31, 31 and 32, 32 is increased, and scavenging efficiency improves and, further, the scavenging flow speed into the combustion actuating chamber is faster. Accordingly, more air-fuel mixture is supplied, thereby making it possible to improve output, fuel economy, and the like. In addition, as the scavenging flow speed into the combustion actuating chamber increases, the flame propagation speed increases, thereby making it possible to improve combustion efficiency. (See FIGS. 8(A) and (B) and FIGS. 9(A) and (B), which will be described later, as regards the scavenging flow).

In addition, because the horizontal scavenging angles $\alpha$ and $\beta$, which are angles of intersection between the lines Ea, Ea and Eb, Eb extended from the guide wall surfaces 31*c*, 31*c* and 32*c*, 32*c*, which respectively define the scavenging passages 31, 31 and 32, 32, towards the intake port 33 are made to be acute, and the lines Ea, Ea extended from the first scavenging passages (31, 31) are made to fall outside of the tangent lines Q that pass through the end points P of the scavenging outlets 32*b*, 32*b* that are closest to the intake port 33 among the respective scavenging outlets 31*b*, 31*b* and 32*b*, 32*b* of the scavenging passages 31, 31 and 32, 32, it is possible to impart directionality to the air-fuel mixture blown out towards the intake port 33 of the combustion actuating chamber 15 from the scavenging outlets 31*b*, 31*b* and 32*b*, 32*b*, as a result of which it is possible to suppress the short-circuiting of fresh charge (unburnt air-fuel mixture). For this reason, in combination with the above-mentioned effects of the shape and of reducing the passage sectional area, there are considerable improvements in scavenging efficiency and combustion efficiency, making it possible to dramatically reduce THC, while at the same time making it possible to further improve output and fuel economy.

Figure 5:
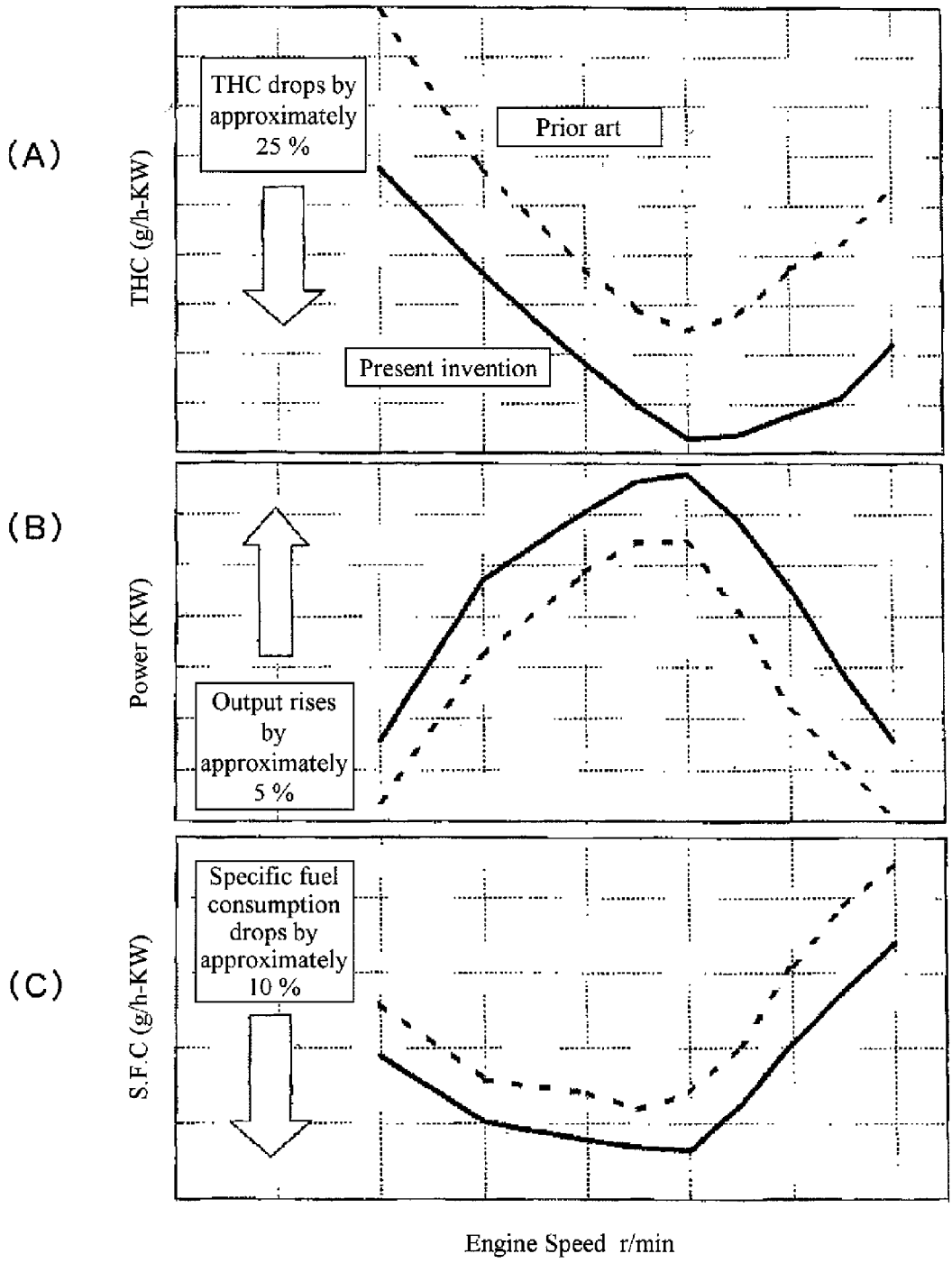
FIGS. 5(A) through (C) show graphs indicating the results of comparative experiments between the first embodiment (present invention) and the conventional example (prior art), where FIGS. 5(A), (B) and (C) respectively indicate THC, output (power) and specific fuel consumption (S.F.C.).

In fact, comparative experiments where the present embodiment (present invention) and the conventional example (prior art) were operated under the same conditions produced the results shown in FIGS. 5(A) through (C). FIG. 5(A) indicates THC, (B) output (power), and (C) specific fuel consumption (S.F.C.). From these results, it was confirmed that with the present invention, as compared to the prior art and across the entire revolution rate range, THC drops by approximately 25%, output rises by approximately 5%, and specific fuel consumption drops by approximately 10%.

Further, in a reverse scavenged two-stroke internal combustion engine of this type, for purposes of convenience in molding the cylinder and the crankcase, the lower ends of the scavenging passages 31, 31 and 32, 32 are ordinarily made to open to the main bearing receiving face 14 of the upper crankcase 12A. In other words, when the lower ends of the scavenging passages 31, 31 and 32, 32 are closed, they become undercut portions, making molding difficult. In the present embodiment, because the sectional shapes of the scavenging passages 31, 31 and 32, 32 are made to be a triangle-like shape as mentioned above, and the passage sectional area is made considerably smaller than its conventional counterpart (approximately 60% of the conventional example in the embodiments of the present invention), the opening area of the main bearing receiving face 14 is made considerably smaller than is conventional. Consequently, the area of the main bearing receiving face 14 subjected to pressure can be made greater than its conventional counterpart, as a result of which support for the crankshaft stabilizes, and it is possible to suppress torque variation and the like as much as possible. In addition, since stiffness increases, deformation by heat is suppressed as well, and seizure resistance improves.

In addition to the above, in a two-stroke internal combustion engine, fuel (gasoline) and lubrication oil are ordinarily used in mixture. However, the fuel-lubrication oil mixture in the air-fuel mixture introduced into the crankchamber 18 is, particularly during high-speed revolution, subjected to centrifugal separation, and much of it is separated from the gas and adheres to the wall surface of the crankchamber 18 and the like. In this case, since the passage sectional areas of the scavenging passages 31, 31 and 32, 32 are reduced, it becomes difficult for the highly viscous lubrication oil within the air-fuel mixture to enter the scavenging passages 31, 31 and 32, 32. Consequently, the separated lubrication oil accumulates within the crankcase, and seizure resistance thus improves.

Figure 6:
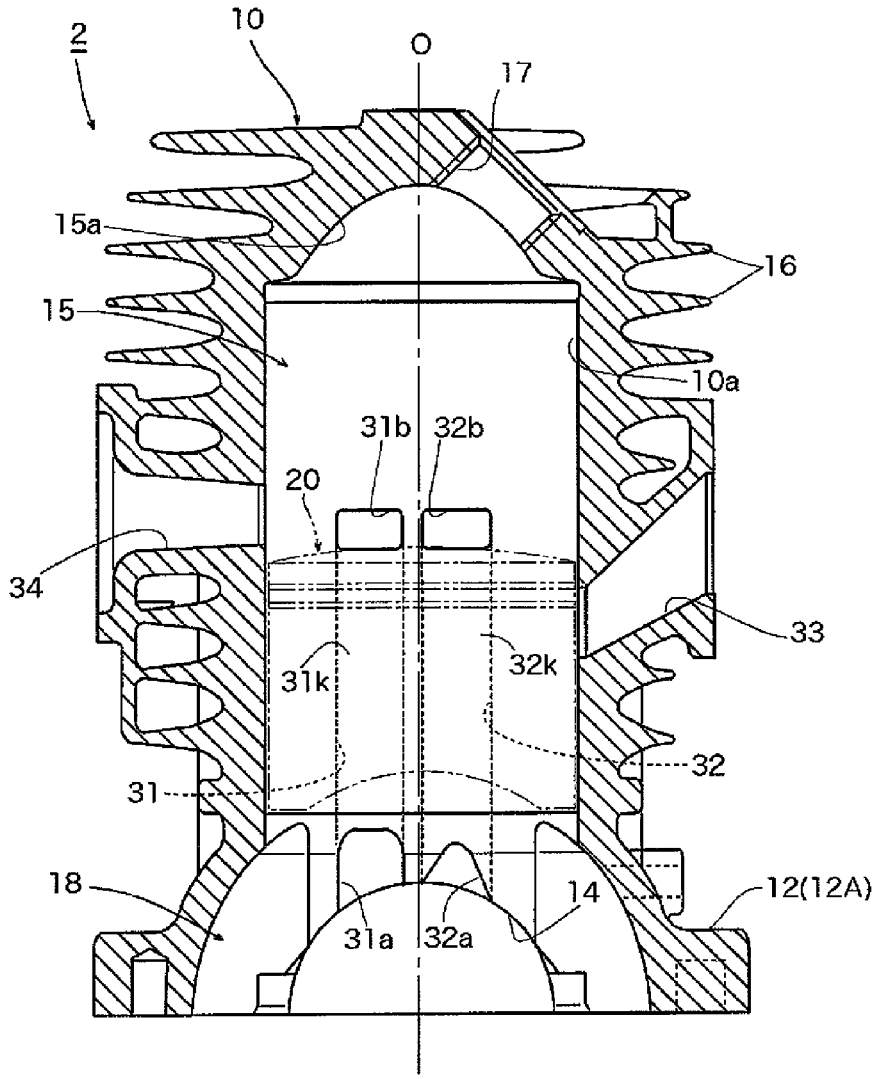
FIG. 6 is a vertical sectional view showing the second embodiment of a two-stroke internal combustion engine according to the present invention.
Figure 7:
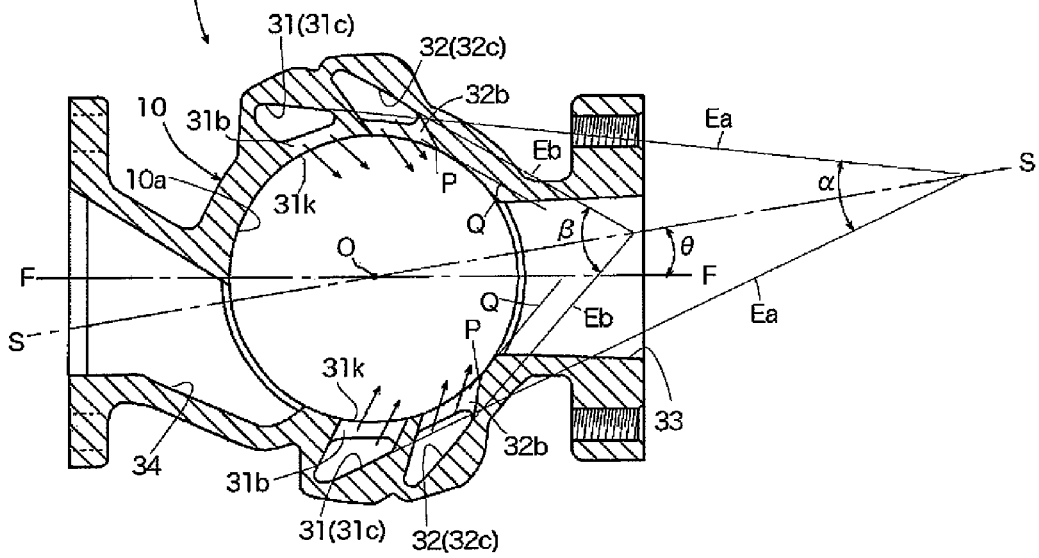
FIGS. 7(A) and (B) are sectional views of the second embodiment and conventional example 2, respectively, that correspond to the sectional views of the first embodiment and conventional example 1 respectively shown in FIGS. 2(A) and (B).
Figure 7:
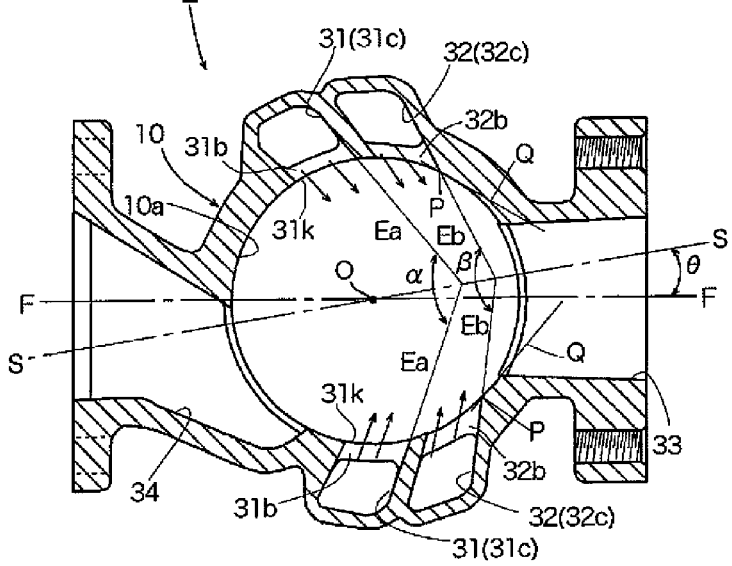

FIG. 6 is a vertical sectional view showing the second embodiment of a two-stroke internal combustion engine according to the present invention. FIGS. 7(A) and (B) are sectional views of the second embodiment and conventional example 2, respectively, which correspond to the sectional views of first embodiment and conventional example 1 shown in FIGS. 2(A) and (B).

In FIG. 6 and FIGS. 7(A) and (B), like parts corresponding to the respective parts in the above-discussed first embodiment and parts that serve the same functions are designated with like reference numerals while omitting redundant descriptions. A description is provided below focusing mainly on how they differ.

With respect to the reverse scavenged two-stroke internal combustion engines 2, 2' of the second embodiment and conventional example 2, respectively, the scavenging passages 31, 31 and 32, 32 are so provided as to be symmetrical about an inclined vertical section S-S that is inclined, as viewed planarly, by a predetermined angle θ relative to a central vertical section F-F that bisects the intake port 33. Further, the exhaust port 34 is so provided as to be eccentric relative to the central vertical section F-F as viewed planarly. In all other respects, they are respectively configured in the same manner as the first embodiment and conventional example 1.

With this configuration, too, substantially similar working effects as those of the first embodiment are achieved. Further, with the two-stroke internal combustion engine 2 of the second embodiment, the upper portions or the whole of the scavenging inlets (cutout openings) 32*a*, 32*a* formed at the lower end portions of the partitions 32*k*, 32*k* of the second scavenging passages 32, 32 located on the side of the intake port 33 are substantially triangular where they become narrower towards the upper side. More specifically, they are triangular, where the left and right sides that form a vertex angle are straight lines except for the portion near the vertex (rounded corner portion). In other words, they are of a triangular shape that expands at a substantially constant rate of change the closer it gets to the lower end opening portion. The opening area and height of the scavenging inlets (cutout openings) 32*a*, 32*a* are made to be less than the opening area and height of the substantially rectangular scavenging inlets (cutout openings) 31*a*, 31*a* formed in the first scavenging passages 31, 31 located on the side of the exhaust port 34.

The triangular scavenging inlets (cutout openings) 32*a*, 32*a* have their vertex portions located at a center portion in the width direction and the vertex angle thereof is set at 130 degrees or below.

By thus having the upper portions or the whole of the scavenging inlets (cutout openings) 32*a*, 32*a* formed in the lower end portions of the partitions 32*k*, 32*k* of the second scavenging passages 32, 32 be of a substantially triangular shape that becomes narrower towards the upper side, or more specifically of a triangular shape that becomes wider at a substantially constant rate of change as it gets closer to the lower end opening portion, when the fresh charge that is compressed at the crankchamber 18 flows into the scavenging passages through the scavenging inlets 32*a*, 32*a*, the fresh charge is pushed in at a single focused point. Consequently, the directionality and flow speed of the scavenging flow increase and scavenging efficiency improves, thereby suppressing short-circuiting and reducing THC, while at the same time bringing about improvements in fuel economy, output, and the like.

In addition, because the upper portions or the whole of the scavenging inlets 32*a*, 32*a* are made to be of a substantially triangular shape and the opening areas of the scavenging inlets are made smaller than those of a conventional device having substantially rectangular scavenging inlets, the flow speed of the scavenging flow becomes even faster. Consequently, a further reduction in THC, and further improvements in fuel economy and output are achieved. Further, because the opening areas of the scavenging inlets are made small, the area of the cylinder bore wall surface, which is the sliding surface for the piston, increases, as a result of which the stiffness (strength) of the cylinder increases, making it possible to enhance the durability and output stability of the cylinder and the piston.

Further, because the upper portions or the whole of the scavenging inlets 32*a*, 32*a* are made to be of a substantially triangular shape, changes in the piston sliding area in the cylinder 10 become more constant and gradual as compared to a conventional device having substantially rectangular scavenging inlets, making it possible to avoid rapid changes in the piston bearing capacity of the cylinder 10. Consequently, deformation of and/or damage to the piston 20 and the cylinder 10, as well as accompanying output drops and the like, become less likely, making it possible to further enhance the durability and output stability of the cylinder 10 and the piston 20.

Further, because the upper portions or the whole of the scavenging inlets 32*a*, 32*a* are made to be substantially triangular, the rate of temperature change that the circumferential surface of the piston passing by the scavenging inlets 32*a*, 32*a* is subjected to becomes substantially constant. Consequently, rapid temperature changes of the circumferential surface of the piston are prevented, thereby making it possible to improve the heat deformation resistance and durability of the piston.

In addition, because the upper portions or the whole of the scavenging inlets 32*a*, 32*a* are of a substantially triangular shape and their opening areas are made small, it becomes difficult for the highly viscous lubrication oil within the air-fuel mixture to enter the scavenging passages, and the separated lubrication oil thus accumulates within the crankcase. Consequently, such effects as a further improvement in seizure resistance and the like are achieved.

FIGS. 8(A) and 9(A), and FIGS. 8(B) and 9(B) respectively show analytical views of the scavenging flows of the second embodiment (present invention) and conventional example 2 (prior art). The small arrows in these analytical views represent the behavior (flow directions) of the fresh charge (air-fuel mixture) and the combustion waste gas (exhaust gas) with their orientation, and the flow speed with the darkness of their color. Darker (i.e., closer to black) colors represent faster flow speeds, while lighter (i.e., closer to white) colors represent slower flow speeds.

Figure 8:
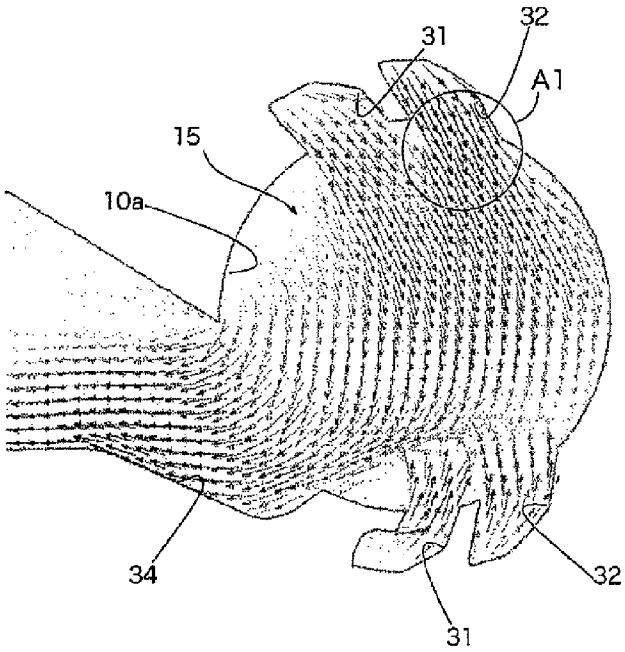
FIGS. 8(A) and (B) are analytical plan views respectively showing the scavenging flow of the second embodiment (present invention) and conventional example 2 (prior art).
Figure 8:
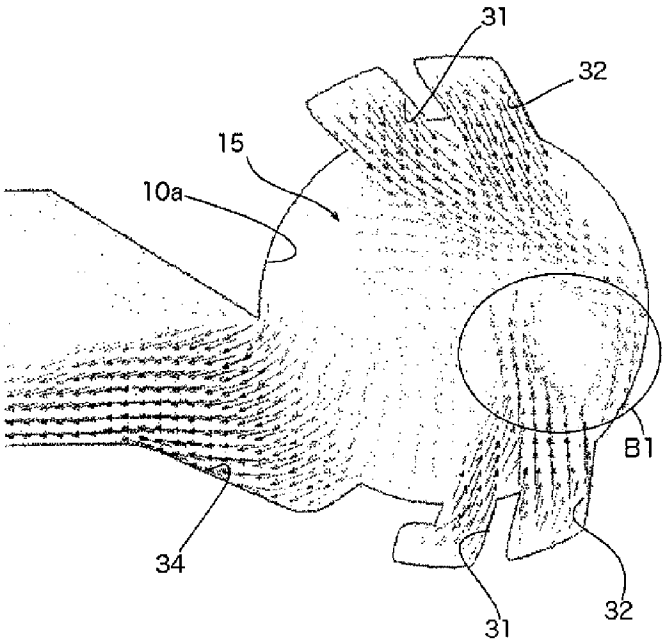
Figure 8:
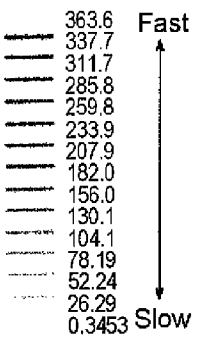
Figure 9:
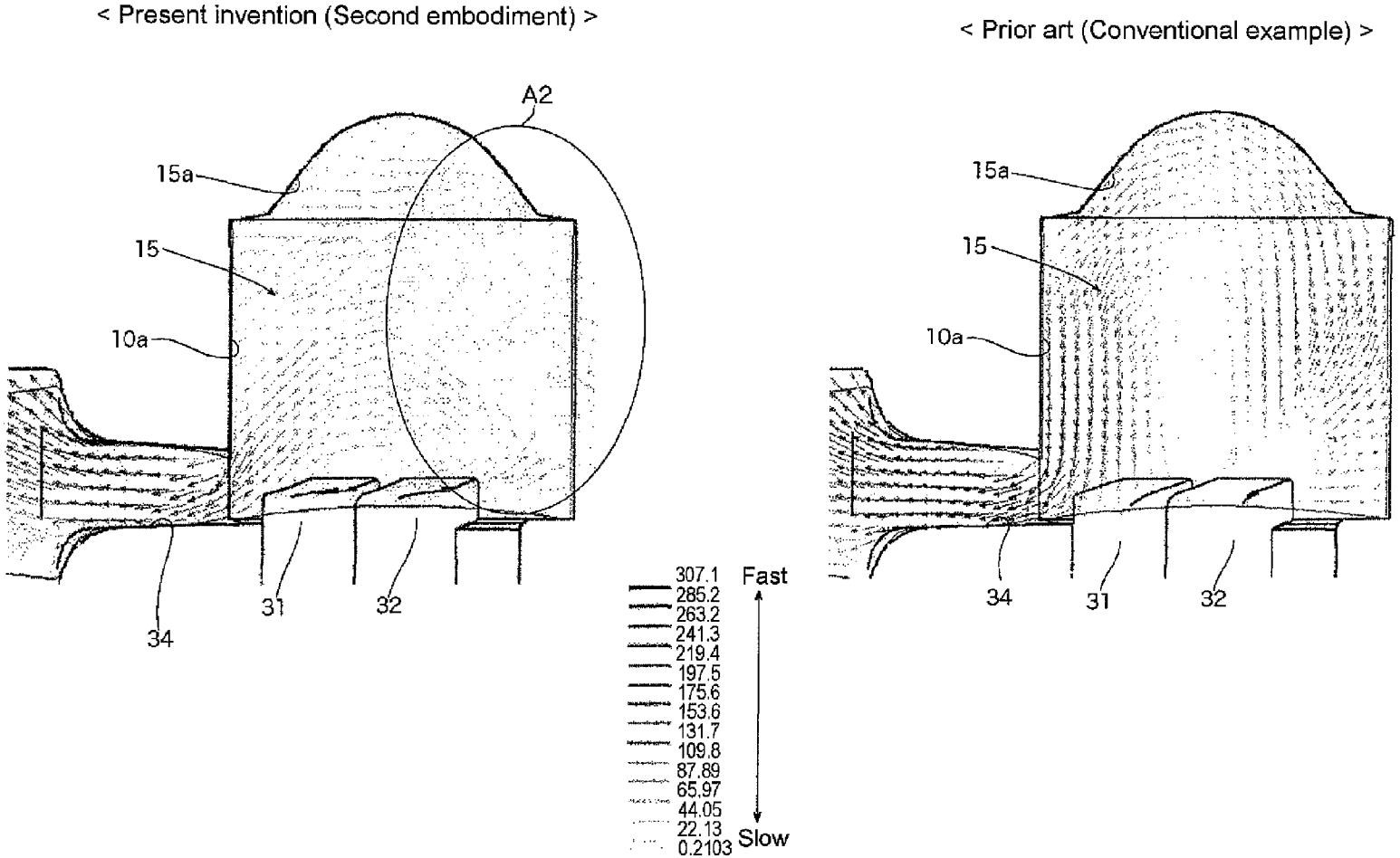
FIGS. 9(A) and (B) are analytical side views respectively showing the scavenging flow of the second embodiment (present invention) and conventional example 2 (prior art).

From the analytical plan views in FIGS. 8(A) and (B), it can be seen that the present invention has a greater area of dark colors within the combustion actuating chamber 15 as compared to the prior art, and that the scavenging flow speed is therefore considerably faster in the present invention than in the prior art. In particular, in the present invention, high-speed flow is observed in the vicinity (portion A1) of the scavenging outlet of one of the second scavenging passages 32 located on the side opposite the exhaust port. Further, the scavenging flow follows a smooth arc (turning around at the cylinder bore wall surface 10*a* portion on the side opposite the exhaust port) and heads towards the exhaust port 34. In contrast, in the prior art, it can be seen that the flow speed is generally slow and, further, that the scavenging flows blown out from the two pairs of scavenging passages 31, 31 and 32, 32 interfere with each other at a mid-portion thereof (portion B1 on the side opposite the exhaust port).

Thus, with the present invention, it is possible to increase the scavenging flow speed, while at the same time imparting a predetermined directionality to the scavenging flow as mentioned above. Scavenging efficiency therefore improves, thereby making it possible to reduce the short-circuited amount (THC). At the same time, since the scavenging flow speed into the combustion actuating chamber is fast, a greater amount of air-fuel mixture is supplied, thereby making it possible to improve output, fuel economy, and the like. In addition, it should be understood that as the scavenging flow speed into the combustion actuating chamber increases, the flame propagation speed also increases, thereby allowing for an improvement in combustion efficiency On the other hand, in the analytical side views in FIGS. 9(A) and (B), the scavenging flow in the present invention is directed towards the side of the cylinder bore wall surface 10*a* on the side opposite the exhaust port (i.e., towards portion A2), and flows in such a manner as to glide over the cylinder bore wall surface. In addition, with respect to the upward flow from this portion towards the combustion chamber portion 15*a*, the flow speed thereof is slow, and the flow in the vertical direction is turbulent. In particular, in the portion of the combustion chamber portion 15*a* on the side opposite the exhaust port, there is an occurrence of turbulence that is not observed in the prior art.

Here, it is known that as the turbulence of the air-fuel mixture becomes greater in the combustion chamber, the burning rate increases, and combustion is promoted. It is thus believed that as moderate turbulence occurs in the combustion chamber as mentioned above, combustion of the unignited air-fuel mixture, which would have conventionally become unburnt remnants, is promoted, and that combustion efficiency further improves.

What is claimed is:

1. A two-stroke internal combustion engine comprising:

at least one pair of scavenging passages that adopts a reverse scavenging system in such a manner as to communicate with a combustion actuating chamber formed above a piston with a crankchamber, wherein a horizontal sectional shape of the at least one pair of the scavenging passages is triangular along substantially the entire lengths of the at least one pair of the scavenging passages, where a cylinder outer circumferential side of the horizontal sectional shape is narrowest and a cylinder bore wall surface side of the horizontal sectional shape is wide, and horizontal scavenging angles of intersection formed between lines extended towards an intake port from guide wall surfaces that define the at least one pair of the scavenging passages are acute.

2. The two-stroke internal combustion engine according to claim 1, wherein the lines extended from the at least one pair of the scavenging passages intersect outside of tangent lines that pass through end points on scavenging outlets of the at least one pair of the scavenging passages that are closest to the intake port.

3. The two-stroke internal combustion engine according to claim 2, wherein the at least one pair of the scavenging passages are provided symmetrically about a central vertical section that bisects the intake port.

4. The two-stroke internal combustion engine according to claim 2, wherein the at least one pair of the scavenging passages are provided symmetrically about an inclined vertical section that is, as viewed planarly, inclined by a predetermined angle relative to a central vertical section that bisects at least one of the intake port and an exhaust port.

5. The two-stroke internal combustion engine according to claim 4, wherein the central vertical section bisects the exhaust port, and the exhaust port is, as viewed planarly, so provided as to be eccentric relative to the central vertical section.

6. The two-stroke internal combustion engine according to claim 1, wherein the at least one pair of the scavenging passages are provided symmetrically about a central vertical section that bisects the intake port.

7. The two-stroke internal combustion engine according to claim 1, wherein the at least one pair of the scavenging passages are provided symmetrically about an inclined vertical section that is, as viewed planarly, inclined by a predetermined angle relative to a central vertical section that bisects at least one of the intake port and an exhaust port.

8. The two-stroke internal combustion engine according to claim 7, wherein the central vertical section bisects the exhaust port, and the exhaust port is, as viewed planarly, so provided as to be eccentric relative to the central vertical section.

9. The two-stroke internal combustion engine according to claim 1, wherein a cylinder and an upper crankcase are formed integrally, and lower ends of the at least one pair of the scavenging passages open to a main bearing receiving face of the upper crankcase.

10. The two-stroke internal combustion engine according to claim 1, wherein the at least one pair of the scavenging passages in large part comprises passage portions with partitions, and a cutout opening or through-hole that serves as a scavenging inlet, an upper portion or the whole of which is of a substantially triangular shape that is narrower towards an upper side, is formed in a lower end portion of at least one of the partitions.

11. The two-stroke internal combustion engine according to claim 10, comprising two pairs of the scavenging passages, wherein the cutout opening or through-hole, the upper portion or the whole of which is of the substantially triangular shape, is formed in the lower end portion of at least one of the partitions of the scavenging passages located on the side of the intake port.

12. The two-stroke internal combustion engine according to claim 10, wherein the upper portion or the whole of the cutout opening or through-hole that serves as the scavenging inlet is of a triangular shape that widens at a constant rate of change towards a lower end opening portion.

13. The two-stroke internal combustion engine according to claim 12 comprising two pairs of the scavenging passages, wherein the cutout opening or through-hole, the upper portion or the whole of which is of the substantially triangular shape, is formed in the lower end portion of at least one of the partitions of the scavenging passages located on the side of the intake port.

* * * * *